US010255788B2

(12) United States Patent
Alkire et al.

(10) Patent No.: US 10,255,788 B2
(45) Date of Patent: Apr. 9, 2019

(54) ELECTRICAL SAFETY ANALYZER

(71) Applicant: PRONK TECHNOLOGIES, INC., Sun Valley, CA (US)

(72) Inventors: Gregory Randolph Alkire, Keene, CA (US); Mike Rosenman, Honolulu, HI (US); Karl A. Ruiter, Honolulu, HI (US)

(73) Assignee: PRONK TECHNOLOGIES, INC., Sun Valley, CA (US)

( * ) Notice: Subject to any disclaimer, the term of this patent is extended or adjusted under 35 U.S.C. 154(b) by 0 days.

(21) Appl. No.: 15/875,972

(22) Filed: Jan. 19, 2018

(65) Prior Publication Data

US 2018/0211508 A1 Jul. 26, 2018

Related U.S. Application Data

(60) Provisional application No. 62/448,931, filed on Jan. 20, 2017.

(51) Int. Cl.

| | |
|---|---|
| ***G08B 21/00*** | (2006.01) |
| ***G08B 21/18*** | (2006.01) |
| ***G08B 5/36*** | (2006.01) |

(52) U.S. Cl.

CPC ..... *G08B 21/185* (2013.01); *G08B 5/36* (2013.01)

(58) Field of Classification Search

CPC .... G08B 21/185; G01R 31/08; G01R 31/025; G01R 31/02; G01R 31/2879; H04B 3/46

USPC ..... 340/647, 649, 650, 651, 657; 436/43; 324/551, 557, 545, 500, 510, 750.01

See application file for complete search history.

(56) References Cited

U.S. PATENT DOCUMENTS

| | | | | |
|---|---|---|---|---|
| 6,054,865 A * | 4/2000 | Bald | G01R 27/20 | 324/545 |
| 8,982,338 B2 * | 3/2015 | Hamilton | G01N 23/223 | 356/72 |
| 2009/0045802 A1 * | 2/2009 | Matias | G01R 19/14 | 324/133 |
| 2009/0212964 A1 * | 8/2009 | Hibma | G01R 19/16547 | 340/657 |
| 2015/0093834 A1 * | 4/2015 | Knecht | G01N 35/04 | 436/43 |

* cited by examiner

*Primary Examiner* — Toan N Pham

(74) *Attorney, Agent, or Firm* — Brooks Acordia IP Law, PC; Pejman Yedidsion; Christopher Weiss

(57) ABSTRACT

An electrical safety analyzer, including: a transparent outer casing; at least one light emitting diode (LED) disposed within the transparent outer casing; a processor and addressable memory, where the processor is configured to: run one or more tests for electrical safety; determine a pass or fail condition for each test; and illuminate the at least one LED based on the determined condition, where an illumination of the at least one LED illuminates the transparent outer casing.

15 Claims, 7 Drawing Sheets

ELECTRICAL SAFETY ANALYZER

CROSS-REFERENCE TO RELATED APPLICATIONS

This application claims priority to and benefit of Provisional Patent Application No. 62/448,931 filed Jan. 20, 2017, which is hereby incorporated by reference in its entirety for all purposes.

TECHNICAL FIELD

The invention relates to electrical safety analyzers, and more particularly, to an electrical safety analyzer notifying a user of the results of an electrical safety test.

BACKGROUND

An electrical safety analyzer is used to determine if a product is electrically safe.

SUMMARY

Embodiments of the present application comprise devices, methods, and systems where an electrical safety analyzer may comprise: a transparent outer casing; at least one light emitting diode (LED) disposed within the transparent outer casing; a processor and addressable memory, wherein the processor is configured to: run one or more tests for electrical safety; determine a pass or fail condition for each test of the one or more tests; and illuminate the at least one LED based on the determined condition, wherein an illumination of the at least one LED illuminates the transparent outer casing. In one embodiment, the at least one LED illuminates the transparent outer casing in a red color if at least one of the one or more tests has failed, the at least one LED illuminates the transparent outer casing in a green color if none one of the one or more tests has failed, or the at least one LED illuminates the transparent outer casing in an orange color if at least one of the one or more tests approaches a threshold close to failing.

In another embodiment, the at least one LED illuminates the transparent outer casing after each test of the one of the one or more tests. Additionally, the illumination is green if the test has passed and illumination is red if the test has failed where the illumination color is based on a measurement of each test.

In some embodiments, the processor is further configured to connect to an external device to display a color indicating the result of the one or more tests where the external device is at least one of: a smartphone and a tablet, and wherein a screen of the external device displays a green color for a test pass and a red color for a test failure.

In some other embodiments, the electrical safety analyzer further comprises a speaker, wherein the processor is further configured to emit one or more tones based on at least one of: a measurement in the one or more tests, a test failure, and a test pass.

A method embodiment may comprise: running, by a device comprising a processor and addressable memory, one or more tests for electrical safety; determining, by the processor, a pass or fail condition for each test of the one or more tests; and illuminating, by the processor in communication with at least one LED, the at least one LED based on the determined condition, wherein an illumination of the at least one LED illuminates a transparent outer casing. In one embodiment, the LED illuminates the transparent outer casing in at least one of: a red color if at least one of the one or more tests has failed, a green color if none one of the one or more tests has failed, and an orange color if at least one of the one or more tests approaches a threshold close to failing.

The method embodiment may further comprise illuminating by the processor in communication with at least one LED, the at least one LED after each test of the one of the one or more tests and additionally, transmitting, by the processor in communication with a transceiver, the pass or fail condition of each test; receiving, by a user device comprising a processor with addressable memory in communication with a transceiver, the pass or fail condition of each test, and displaying, by a processor of the user device in communication with a display, the received pass or fail condition of each test.

A system embodiment may comprise: an electrical safety analyzer comprising: an outer casing; and an accelerometer in communication with a processor and addressable memory, wherein the processor is configured to: run one or more tests for electrical safety; receive a signal from the accelerometer detecting a movement of the electrical safety analyzer; and determine if the received signal indicates that the electrical safety analyzer has been dropped.

In some embodiments, the electrical safety analyzer further comprises one or more relays in communication with the processor, and wherein processor is further configured to: turn off the one or more relays if the processor determines that the electrical safety analyzer has been dropped; and stop running the one or more tests for electrical safety if the processor determines that the electrical safety analyzer has been dropped.

Additionally, the electrical safety analyzer further comprises a display in communication with the processor, and wherein processor is further configured to: prompt a user, via the display, to resume the one or more tests; turn on the one or more relays if the user resumes the one or more tests; and run the one or more tests for electrical safety if the user resumes the one or more tests, where the processor is further configured to: determine a pass or fail condition for each test.

In some embodiments, the system further comprises a user device comprising: a processor having addressable memory; a display in communication with the processor; wherein the processor is configured to: receive the pass or fail condition for each test; store the pass or fail condition for each test; and display, via the display, the pass or fail condition for each test to a user, where the electrical safety analyzer further comprise: at least one light emitting diode (LED) disposed within the outer casing; and an outer casing, wherein at least a portion of the outer casing is transparent. Additionally, the processor may be further configured to: illuminate the at least one LED if at least one of the one or more tests has failed, wherein an illumination of the at least one LED illuminates the transparent outer casing.

BRIEF DESCRIPTION OF DRAWINGS

Embodiments are illustrated by way of example and not limitation in the figures of the accompanying drawings, which may not be drawn to scale, and in which.

DETAILED DESCRIPTION

An electrical safety analyzer is disclosed that allows for generating sensory outputs, such as visual and/or auditory signals, indicating the result of one or more tests for electrical safety. The electrical safety analyzer embodiment may include a transparent outer casing and at least one light emitting diode (LED) disposed within the transparent outer casing, and the electrical safety analyzer may comprise a processor. The processor may have an addressable memory and may run one or more tests for electrical safety, determine a pass or fail condition for each test, and illuminate the at least one LED if at least one of the tests failed. The illuminated LED illuminates the transparent outer casing with, or in, the same color as the LED. This illumination may provide a visual reference, e.g., a green light for all tests passed and a red light for any test failures, to a user of the electrical safety analyzer, irrespective of their relative distance to the device.

In some embodiments, the LED may illuminate after each test in addition to a final illumination at the conclusion of testing. The LED may also be used to indicate, e.g., via a range of colors such as orange, if any of the test values were within a threshold approaching failure so that corrective action may be taken. The electrical safety analyzer may wirelessly communicate, via a wireless communication channel, e.g., via Bluetooth or Wi-Fi, with an external computing device such as a smartphone or tablet. The smartphone or tablet may display a green color for a test pass or a red color for a test failure associated with the safety analyzer. The electrical safety analyzer may also include a speaker, which may emit one or more tones based on a measurement in the tests, a test failure, and/or a test pass.

Figure 1:
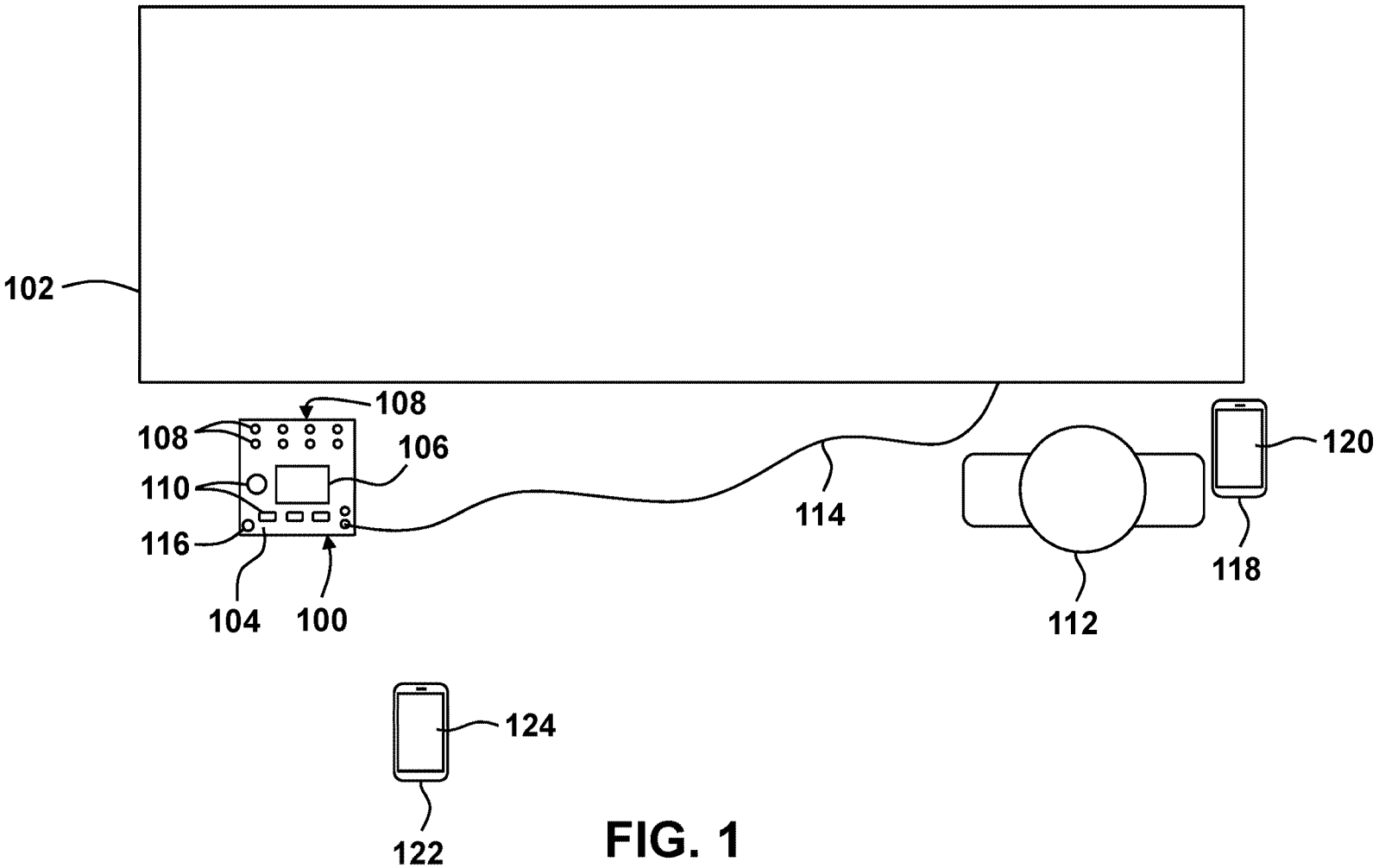
FIG. 1 depicts an example electrical safety analyzer for conducting one or more electrical safety tests on a device.

FIG. 1 depicts an example electrical safety analyzer 100 for conducting one or more electrical safety tests on a device 102. The electrical safety analyzer may include an opaque portion 104 for a user interface having an organic light-emitting diode (OLED) screen 106; one or more electrocardiogram (ECG) patient lead snaps 108 for lead leakage testing and ECG/resp. simulations; and one or more buttons 110 for starting tests, selecting changes to profiles, powering the electrical safety analyzer on/off, configuring profiles, selecting a manual or auto profile, etc. A user 112 may need to be distal from the electrical safety analyzer 100 and/or not in view of the display 106 during the running of one or more tests. For example, the user 112 may need to connect a ground lead 114 from the electrical safety analyzer 106 to a location on the device 102 being tested in order to establish an acceptable ground connection for testing. In some tests, the user 112 may need to hold this ground lead 114 at this location, which makes the user 112 unable to identify any information being shown on the display 106 of the electrical safety analyzer 114.

The electrical safety analyzer 100 may be capable of running a plurality of safety tests on the device 102 to be tested. Each device 102 to be tested may have a different profile, where the profile is a set of tests to be run on a particular device and the corresponding pass or fail criteria for each test. The kind, type, and criteria for each device may also differ based on the area of use. Devices in operating rooms may have different tests and corresponding pass or fail criteria than devices that are not located in patient areas. The electrical safety analyzer 100 may be equipped to perform each safety test individually or to perform a number of tests sequentially.

In the event of a test failure, the user 112 may not be in a location to see the display 106 of the electrical safety analyzer 100. Further, the instance of test failures may be exceedingly rare in many circumstances, e.g., less than one test failure for a device per thousand devices tested. As test failures are rare, tests may be monotonous, and the user 112 is often distal from the electrical safety analyzer 100, accordingly, there is a strong risk of the user 112 not noticing that a test failure has occurred and allowing for corrective action. The impact of not noticing a test failure could be severe for a device in contact with a patient.

The disclosed electrical safety analyzer 100 clearly notifies the user 112 of a test failure so as to prevent any test failures from going unnoticed. The disclosed electrical safety analyzer 100 may include one or more LEDs that illuminate a transparent outer casing 108. At the conclusion of the safety tests, the transparent outer casing 108 may glow red if any safety tests failed for the device 102. The user 112 is able to easily see, even from a distal location, that a test has failed and is unlikely to accidentally ignore this result. The transparent outer casing 108 may also glow green at the end of testing if none of the tests failed. The transparent outer casing 108 may glow a different color, e.g., orange, if all of the tests passed, but some values recorded during the test approached a threshold indicating that corrective action should be taken. Illumination of the transparent outer casing 108 by the one or more LEDS may be after each test and/or at the conclusion of all of the tests on the device 102 being tested. In one embodiment, the electrical safety analyzer 100 device may stay lit until a user reviews and takes an affirmative action, e.g., corrective action, to ensure the test results have been viewed.

The electrical safety analyzer 100 may also include a speaker 116. The speaker 116 may transmit a tone that corresponds to a test measurement, a test pass, and/or a test fail. The speaker 116 may transmit multiple tones to indicate a test measurement, e.g., four beeps to indicate a reading of 400 milliohms. In some embodiments, the transparent outer casing 108 may glow a color in coordination with tones from the speaker 116. The color of the LED illuminating the transparent outer casing may also vary based on the measurement. For example, at a measurement of 400 milliohms, the transparent outer casing 108 may flash four times in a green color. At a measurement of 500 milliohms, the outer casing 108 may flash five times in a red color.

The electrical safety analyzer 100 may wirelessly connect, e.g., via Bluetooth or WiFi, to a user device 118 such as a smartphone or tablet. The user device 118 may display a single color on a screen of the user device 118 based on the test results. The screen 120 may display a green color for a passed test and a red color for a failed test. An application may be downloaded on the user device 118 to facilitate this functionality and/or record test results for later viewing and/or transfer to another device.

In some embodiments, a second user device 122 may also wirelessly connect, e.g., via Bluetooth or WiFi, to the user device 118 or the electrical safety analyzer 100. If a test fails, the second user device 118 may be notified, e.g., via a push notification, email, color displayed on a screen 124, etc. The second user device 122 may be a smartphone, tablet, laptop, computer, etc. The second user device 122 may be accessed by a supervisor or other individual to ensure that any test failures are noted so that any affected device 102 may be taken out of service, repaired, etc. The second user device 118 may receive test results in real-time, or near real-time in order to take corrective measures, e.g., so that a failed device 102 is not used on a patient. The second user device 118 may also be used to access prior tests by the electrical safety analyzer 100. These prior tests may be used to provide historical data and determine whether a device 102 is nearing a fail condition and whether repairs should be made to the device 102 prior to a test failure.

"Applied parts" testing involves testing any part of a medical device that may be designed to come into contact with a patient. The electrical safety analyzer 100 may automatically recognize when "applied parts" testing begins while performing an automatic series of tests. In a manual mode, where the user 112 selects each test, the electrical safety analyzer 100 may recognize that the selected test is an "applied parts" test. During "applied parts" testing, the electrical safety analyzer 100 may apply a voltage to electrocardiogram (ECG) snaps/electrodes via lead wires 114 for testing potential harmful currents through the parts of the device 102 that are "applied" directly to patients. The user 112 may receive a relatively harmless, yet annoying, shock if he or she were to touch the ECG connections during this "applied parts" testing.

To avoid the risk of this shock, the electrical safety analyzer 100 may emit an alarm tone via the speaker 116 during the duration of the "applied parts" testing. The electrical safety analyzer may also illuminate the one or more LEDs that illuminate the transparent outer casing 108 at a set frequency and/or color. For example, during "applied parts" testing, the device may flash at an orange color at a rate of four times faster flashing frequency and/or emit an audible alert testing tone at a four times faster frequency. These indications will make it clear to the user 112 that "applied parts" testing is ongoing and that he or she should not attempt to touch the ECG connections until the indications have ceased and this testing is complete. These light and sound indications may vary from other indications noting that a test has failed, that a test is complete, etc.

Figure 2A:
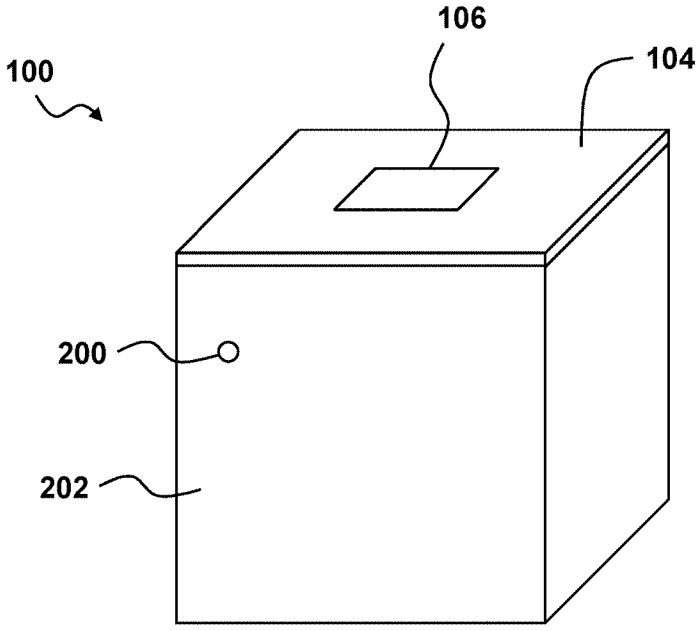
FIG. 2A depicts an embodiment of the example electrical safety analyzer of FIG. 1 having a transparent outer casing.

FIG. 2A depicts an embodiment of the example electrical safety analyzer 100 of FIG. 1 having a transparent outer casing 202. Three or more sides of the electrical safety analyzer 100 may be made from a transparent material such that an LED disposed inside the outer casing 108 illuminates the casing when the LED is turned on. The display 106 of the electrical safety analyzer 100 may not be visible and/or difficult to see during and/or after safety tests.

The color, intensity, and/or number of flashes of light illuminating the outer casing 108 may visually inform a user as to whether the safety tests passed or failed. This clear visual feedback signals the user and prevents a test failure from being unnoticed. One embodiment may comprise a plurality of LEDs disposed inside and placed at specific locations so as to ensure visibility from any and all different angles.

The electrical safety analyzer may also include one or more mounts 200. The mounts 200 may provide a way to detachably attach the electrical safety analyzer to common items, such as shelves, tables, medical equipment, etc. In one embodiment, the mount 200 may be a ¼-20 screw thread for receiving a clamp with a corresponding ½-20 screw thereon. The electrical safety analyzer 100 may be mounted to a shelf that holds one or more medical devices to be tested so that the electrical safety analyzer 100 is easy to access and prevents damage to the electrical safety analyzer 100, e.g., by the electrical safety analyzer 100 falling off of a shelf to which it is not otherwise attached.

Figure 2B:
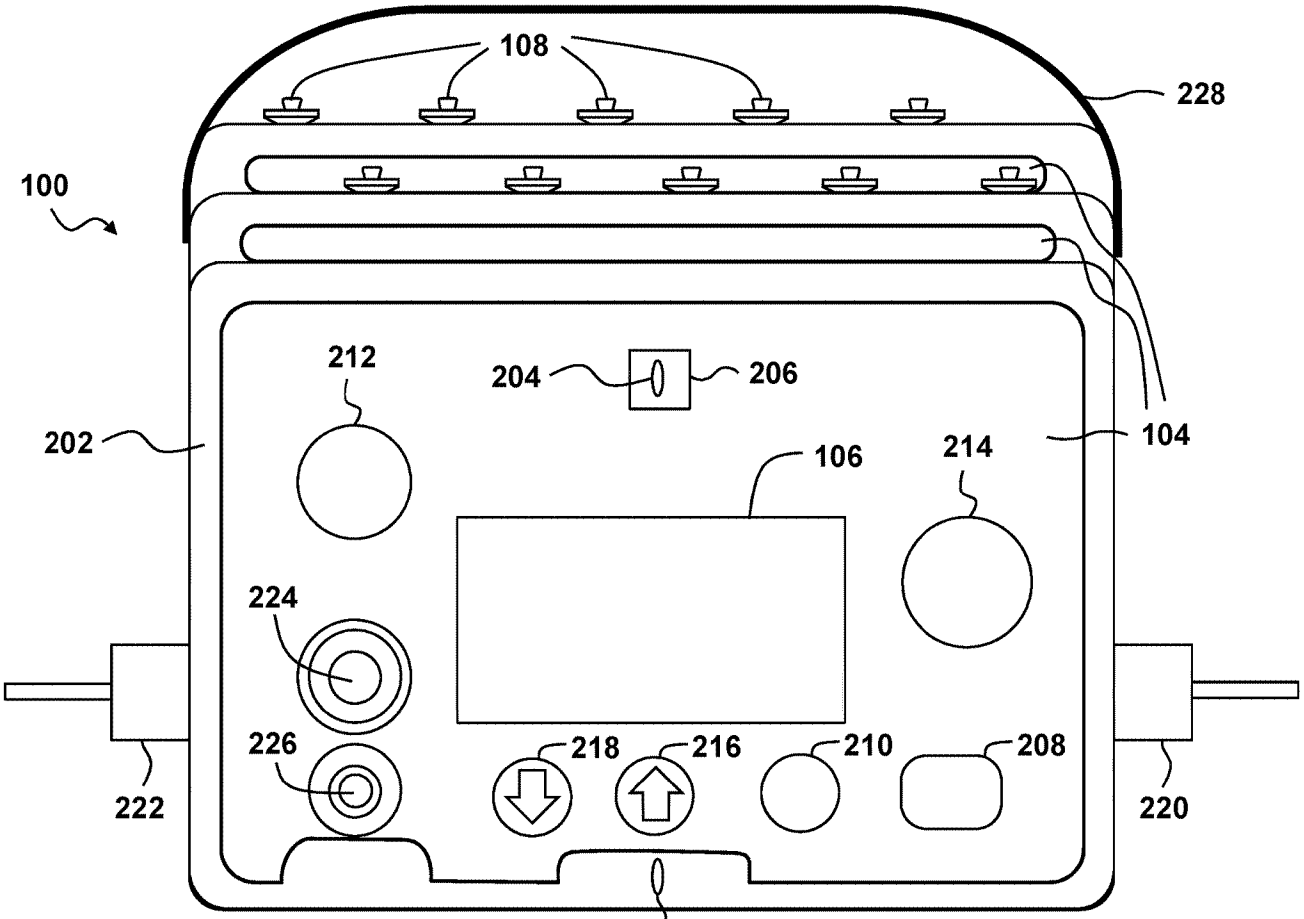
FIG. 2B depicts another embodiment of the example electrical safety analyzer of FIG. 1.

FIG. 2B depicts another embodiment of the example electrical safety analyzer 100 of FIG. 1. The electrical safety analyzer may have a transparent portion 202 that illuminates when one or more LEDs 204, 206 inside the case illuminate. The case may also have an opaque portion 104 providing an area for a user interface, e.g., buttons, screens, instructions, written information, etc. A first LED 204 may be provided proximate a cut-out 206 in the opaque portion 104 to provide extra illumination to a user. A second LED 208 may be disposed distal from the first LED 204 in the case so as to provide illumination throughout the transparent portions 202 of the case and alert a user regardless of where the user is located relative to the electrical safety analyzer 100.

The user interface may contain one or more buttons or screens to allow a user to run electrical safety tests and view results. A manual/auto mode button 208 may allow the user to switch between manual and automatic modes for the electrical safety analyzer 100. The user may be able to store a plurality of automated testing modes that may be run on a plurality of devices to be tested. The user may select, for example, a Ground Resistance, Earth and Enclosure/Chassis Leakage, or Applied Parts Leakage automated test to be performed by the electrical safety analyzer 100 on a device to be tested. The user may also modify the limits in these automated tests, which may affect whether the device to be tested passes or fails the test. A setup button 210 may allow the user to setup the various tests and make adjustments to their criteria. A simulator mode button 212 may enable a simulator mode for the electrical safety analyzer 212.

Once the mode is selected, e.g., manual, auto, simulated, etc., the user may start the test with an enter/start button 214. The user may use an up arrow button 216, a down arrows button 218, and the enter/start button 214 to navigate one or more user interface screens on the display 106. The display 106 may also display the results of the tests, e.g., P indicating pass and F indicating fail next to each test run. The user may also use the user interface screens to see the specific results of each test to determine whether a device may need maintenance or repair in the future.

The electrical safety analyzer 100 may be connected to a power source via an input power connector 220. The electrical safety analyzer 100 may also have an auxiliary power source, e.g., a plurality of batteries, to maintain power to the display 106 and other electronics while moving between rooms to test different pieces of equipment. The auxiliary power source may be used to run tests in simulator mode, but the input power connector 220 may be needed for certain tests.

A power cord 222 for the device to be tested may be connected to a power outlet of a device under test (DUT) on the electrical safety analyzer 100. A plurality of electrocardiograph (ECG) connectors may be connected to ECG snaps 108 disposed on the electrical safety analyzer 100. The ECG snaps 108 may be color coded, e.g., to ease in connecting to plugs from an ECG cart. Test leads 224, 226 may also be connected to the electrical safety analyzer 100.

A handle 226 may be attached to the electrical safety analyzer 100 to provide ease in transport between rooms where devices may need to be tested. The electrical safety analyzer 100 may provide a small form factor so as to allow the electrical safety analyzer 100 to be easily transported between devices to be tested. In some embodiments, a clamp (not shown) or other device may be used to detachably attach the electrical safety analyzer 100 to a shelf, table, camera mount, etc. to secure the electrical safety analyzer 100 during testing.

Figure 3:
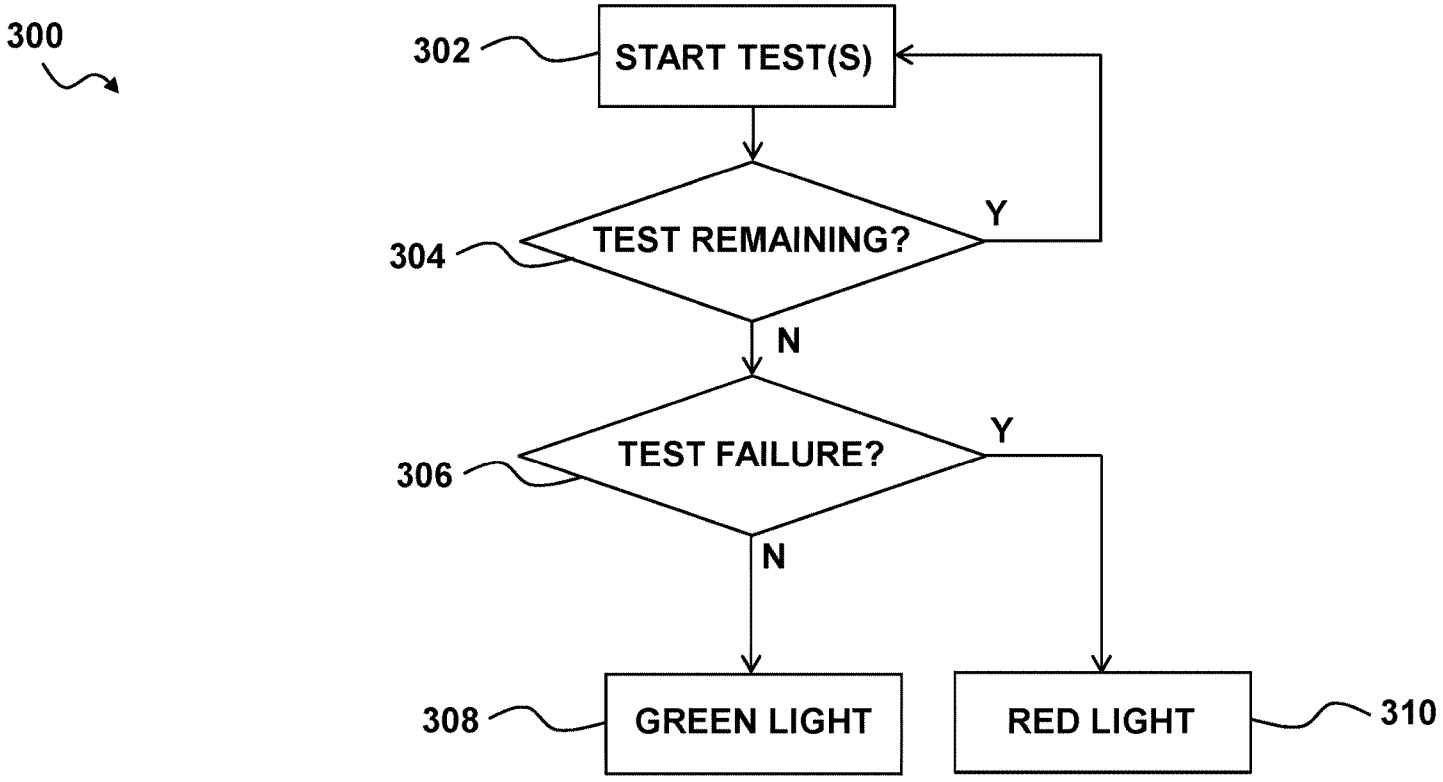
FIG. 3 depicts a block diagram of an example method of conducting one or more electrical safety tests and notifying a user of the test results.

FIG. 3 depicts a block diagram 300 of an example method of conducting one or more electrical safety tests and notifying a user of the test results. First, one or more safety tests are initiated by a user (step 302). A plurality of safety tests may be run consecutively in an automatic mode where the user just needs to start the sequence and then all of the tests in the sequence are run in sequential order. It is determined if there are any additional safety tests that need to be run based on a profile (step 304). If there is another test remaining in the profile, then the next test is run (step 302). If there are no more tests, then it is determined whether any of the safety tests were failures (step 306). If none of the safety tests were failures, then an example green LED is turned on and the outer casing is illuminated in green (step 308). If one or more of the safety tests were failures, then an example red LED is turned on and the outer casing is illuminated in red (step 310).

In some aspects of the present embodiments, an audible tone may also accompany the red LED for at least one failed test. The red LED may remain illuminated once the test is complete and until a user acknowledges the test failure, e.g., via a user interface. This illumination informs the user running the tests with the electrical safety analyzer as to whether or not there were any of the test failures regardless of where the user is located in the room performing the test. The user may navigate the user interface and display to determine which test failed and the results that led to the test failure. In some embodiments, the green LED or red LED may illuminate after each test to indicate whether that particular test in the sequence passed or failed. The green LED or red LED may then illuminate after all of the tests have been run to indicate if there were any failures, e.g., a red LED, or if all the tests passed, e.g., green LED.

Figure 4:
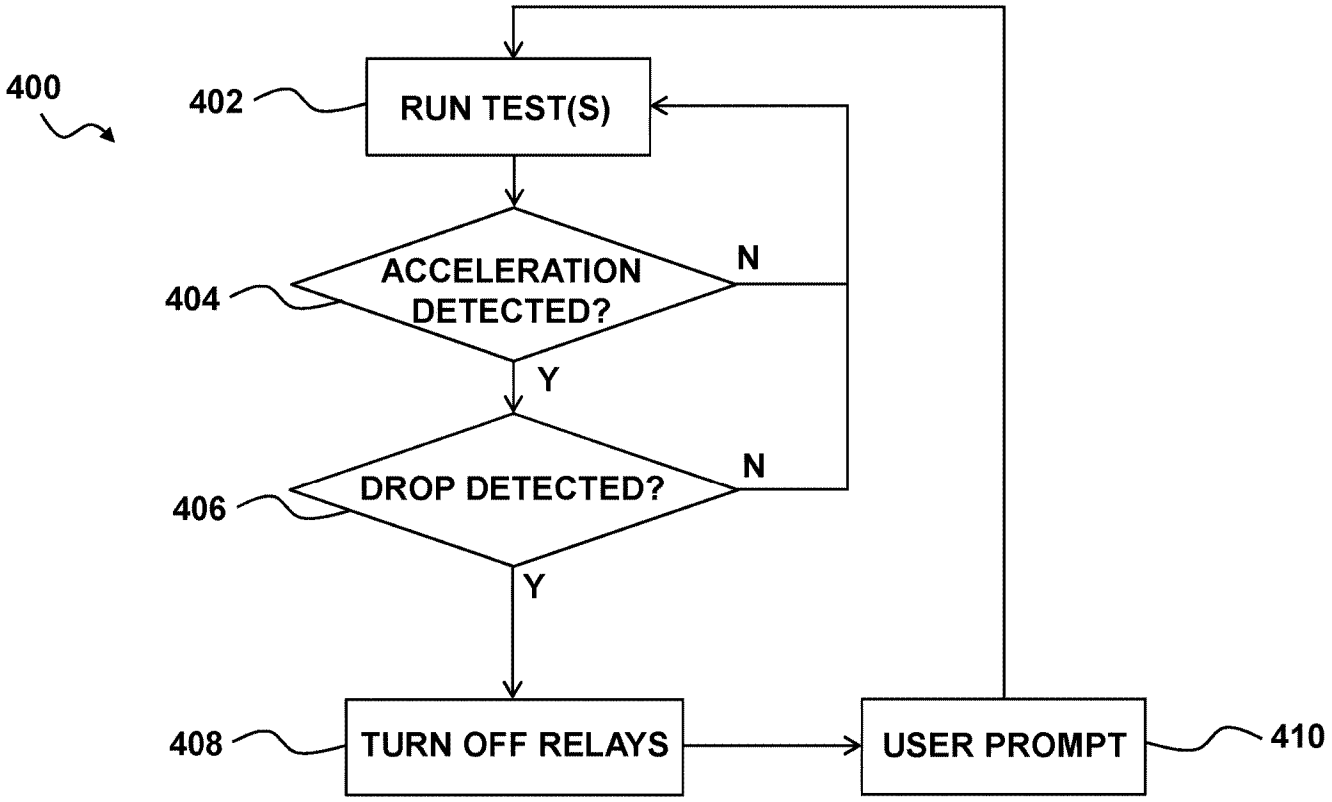
FIG. 4 depicts a block diagram of an example method of checking for a drop to prevent damage to components of an example electrical safety analyzer.

FIG. 4 depicts a block diagram 400 of an example method of checking for a drop to prevent damage to components of an example electrical safety analyzer. First, one or more safety tests are initiated by a user (step 402). An accelerometer in the electrical safety analyzer continually checks for acceleration while the tests are running (step 404). If no acceleration is detected, then the tests continue to run (step 402). If acceleration is detected, then the acceleration is analyzed by a processor of the electrical safety analyzer to determine if a drop is detected (step 406). If a drop is not detected, then the electrical safety analyzer continues to run the tests (step 402).

Acceleration, but not a drop, may be detected if the electrical safety detector is bumped, moved, picked up by a user, etc. The processor of the electrical safety analyzer may analyze the acceleration provided by the accelerometer to determine if it fits a profile of being dropped. If the processor determines that the electrical safety analyzer is dropped, it turns off one or more relays in the electrical safety analyzer (step 408). Turning off the relays and/or other electrical circuits prevents damage to the electrical components of the electrical safety analyzer if the electrical safety analyzer sustains an impact from being dropped.

Due to the small form factor of the electrical safety analyzer, the locations of devices to be tested, and user comfort, the electrical safety analyzer may be susceptible to falls from a height of three feet or more. By determining whether an acceleration is a drop, the processor may act to prevent damage to the electrical safety analyzer.

Once the relays have been turned off, a user prompt may be displayed on the device (step 410). The user prompt may inform the user, e.g., via a display, that the test has been aborted and/or that a drop has been detected. The user may then reposition the electrical safety analyzer and either begin the testing process over or continue testing from before it was stopped (step 402).

Figure 5:
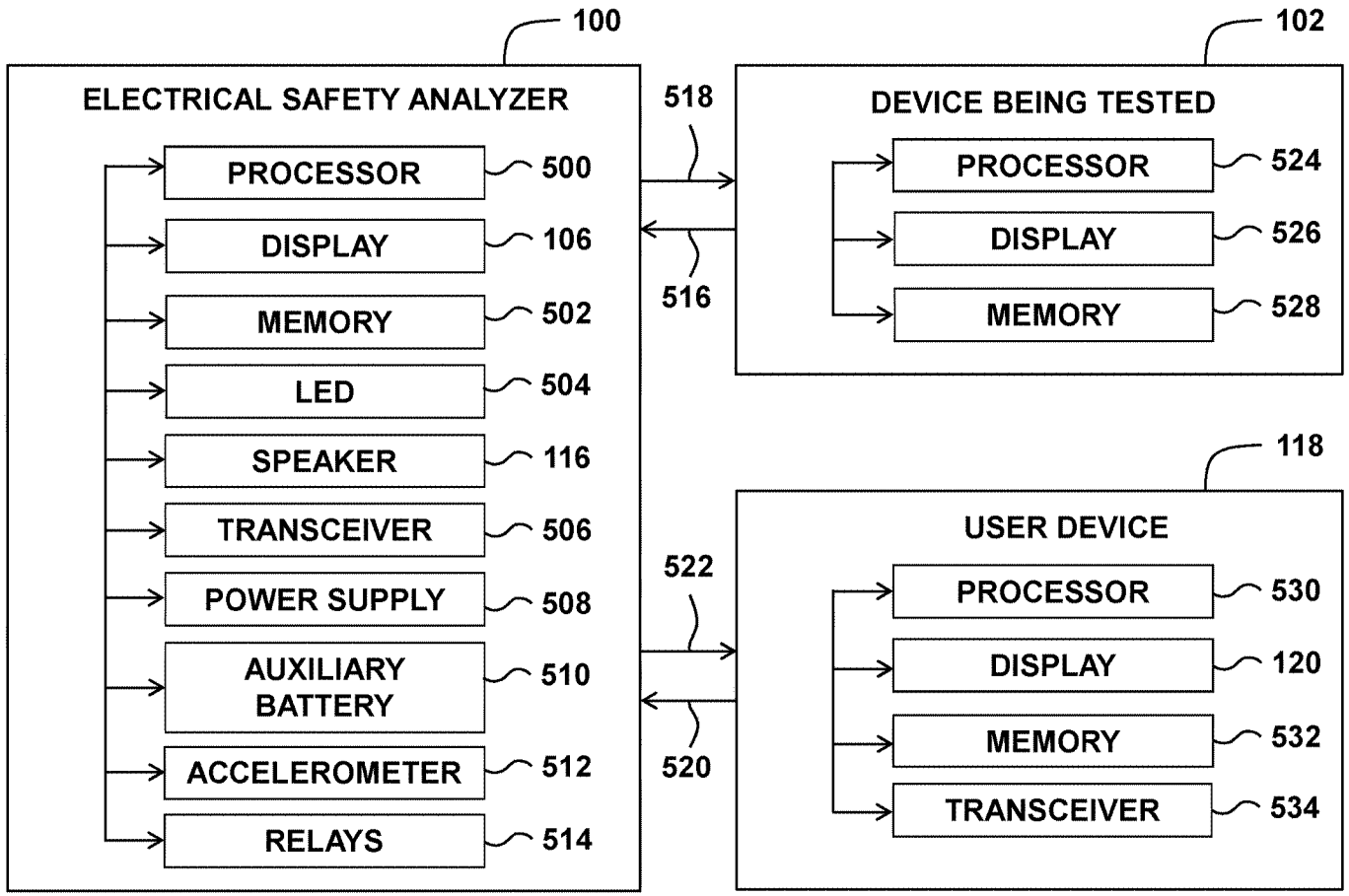
FIG. 5 depicts an example top level functional block diagram of the electrical safety analyzer, device being tested, and user device of FIG. 1.

FIG. 5 depicts an example top level functional block diagram of the electrical safety analyzer 100, device being tested 102, and user device 118 of FIG. 1. The electrical safety analyzer may include a processor 500, a display 106 in communication with the processor 500, an addressable memory 502 in communication with the processor, one or more LEDs 504 in communication with the processor 500, a speaker 116 in communication with the processor 500, a transceiver 506 in communication with the processor 500, a power supply 508 in communication with the processor 500, an auxiliary battery 510 in communication with the processor 500, an accelerometer 512 in communication with the processor, and one or more relays 514 in communication with the processor.

The display 106 may provide a user interface for a user to select a mode, view test results, etc. The memory 502 may store one or more stored modes to perform automatic tests, which may be created or modified by a user. The one or more LEDs 504 may include two or more green and red LEDs to provide illuminate of a case of the electrical safety analyzer 100 to indicate whether a series of tests passed or failed to a user. The speaker 116 may provide an audible tone upon failure of one or more tests in conjunction with the LED 504 illumination. The speaker 116 may also provide a tone in response to user input in a user interface, a completion if each test in a series of tests, etc.

The transceiver 506 may receive data 516 from a device being tested 102, send data 518 to the device to be tested, receive data 520 from the user device 118, and/or send data 522 to the user device 118. In some embodiments, the transceiver 506 may be a receiver and/or a transmitter. The transceiver 506 may use WiFi, Bluetooth, etc. The power supply 508 may use AC or DC power. In some embodiments, the power supply 508 may be connected to an outlet to power the electrical safety analyzer 100. In other embodiments, the power supply may be a battery pack to provide power to the electrical safety analyzer 100.

The electrical safety analyzer 100 may include an auxiliary battery 510, e.g., two or more AA batteries, to maintain power to the display 106 and other electrical components between tests and as the electrical safety analyzer is moved between testing locations. The auxiliary battery may not be sufficient to run certain tests, but may be able to run test in simulated mode.

An accelerometer 512 may constantly sense whether an acceleration is detected during a test. If acceleration is detected, the processor 500 determines whether the sensed acceleration matches a drop profile. If the acceleration matches a drop profile, then the processor turns off one or more relays 514 and/or other electrical components of the electrical safety analyzer 100. Accordingly, the electrical safety analyzer 100 is less likely to sustain damage to electronics during a fall with the relays 514 or other electrical components turned off and the lifespan of the electrical safety analyzer 100 is increased. If the processor 500 determines that the acceleration does not meet a drop profile, e.g., due to a nudge, controlled movement by a user, etc., then the tests may continue and the relays 514 or other electrical components are not turned off.

The device being tested 102 may include a processor 524, a display 526 in communication with the processor, and addressable memory 528 in communication with the processor 524. For example, the device to be tested 102 may be a medical device, such as an ECG cart.

The user device 118 may include a processor 530, a display 120 in communication with the processor 530, an addressable memory 523 in communication with the processor 530, and a transceiver 534 in communication with the processor 530. The user device 118 may be a smartphone, tablet, or computer. The user device 118 may run an application or access a web-based application that receives information relating to tests being conducted on the electrical safety analyzer. The application may allow a user to store test results, modify limits on tests, set up one or more stored automated testing modes, initiate testing, pause testing, etc.

Figure 6:
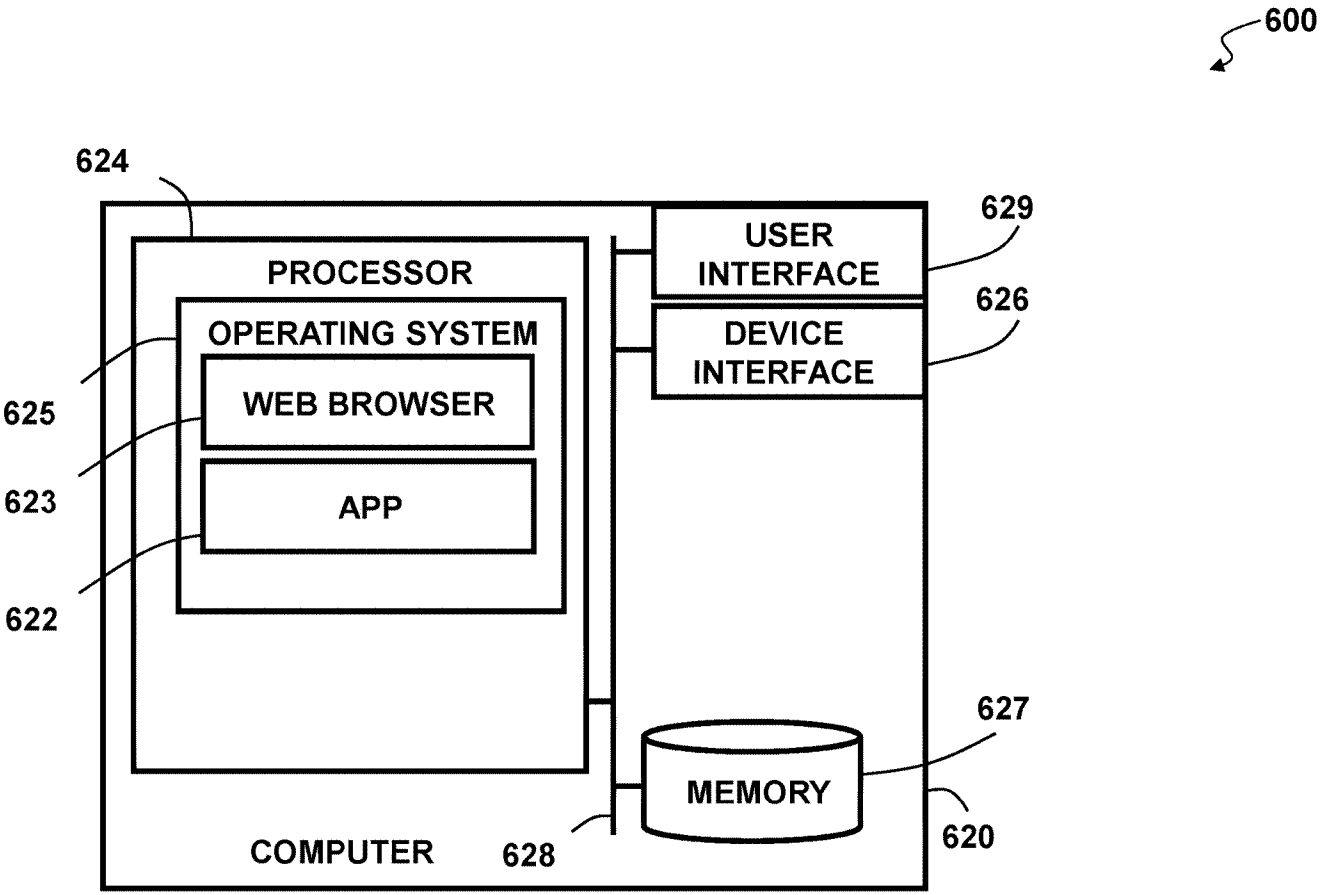
FIG. 6 illustrates an example top level functional block diagram of a computing device embodiment of an imaging system.

FIG. 6 illustrates an example top level functional block diagram of a computing device embodiment of an electrical safety analyzer 100, device being tested 102 or user device 118 of FIG. 5. The example embodiment 600 is shown as a computing device 620 having a processor 624, such as a central processing unit (CPU), addressable memory 627, an external device interface 626, e.g., an optional universal serial bus port and related processing, and/or an Ethernet port and related processing, and an optional user interface 629, e.g., an array of status lights and one or more toggle switches, and/or a display, and/or a keyboard and/or a pointer-mouse system and/or a touch screen. Optionally, the addressable memory 627 may for example be: flash memory, eprom, and/or a disk drive or other hard drive. These elements may be in communication with one another via a data bus 628. The processor 624 may have an operating system 625 such as one supporting a web browser 623 and/or applications 622, which may be configured to execute steps of a process according to the example embodiments described herein.

It is contemplated that various combinations and/or subcombinations of the specific features and aspects of the above embodiments may be made and still fall within the scope of the invention. Accordingly, it should be understood that various features and aspects of the disclosed embodiments may be combined with or substituted for one another in order to form varying modes of the disclosed invention. Further it is intended that the scope of the present invention herein disclosed by way of examples should not be limited by the particular disclosed embodiments described above.

What is claimed is:

1. An electrical safety analyzer, comprising:

an outer casing comprising a transparent portion;

at least one light emitting diode (LED) disposed within the outer casing; and a processor and addressable memory, wherein the processor is configured to:

run a plurality of tests for electrical safety based on a profile of a device to be tested, wherein the profile of the device to be tested comprises a pass criteria and a fail criteria for each test of the plurality of tests;

determine a pass condition or a fail condition for each test of the plurality of tests based on the pass criteria and the fail criteria for each test;

determine if at least one test of the plurality of tests has the fail condition; and illuminate the at least one LED after the last test of the plurality of tests has completed if at least one test of the plurality of tests has the fail condition, wherein an illumination of the at least one LED illuminates the transparent portion of the outer casing.

2. The electrical safety analyzer of claim 1, wherein the at least one LED illuminates the transparent portion of the outer casing in a red color if at least one test of the one or more tests has the fail condition, and wherein the at least one LED illuminates the transparent outer casing in a green color if none one of the one or more tests has the fail condition.

3. The electrical safety analyzer of claim 1, wherein the profile of the device to be tested further comprises a threshold approaching the fail criteria.

4. The electrical safety analyzer of claim 3, wherein the processor is further configured to:

determine if each test of the plurality of tests with the pass condition is in the threshold approaching the fail criteria illuminate the at least one LED after the last test of the plurality of tests has completed if at least one test of the plurality of tests is in the threshold approaching the fail criteria, wherein the illumination of the at least one LED illuminates the transparent portion of the outer casing.

5. The electrical safety analyzer of claim 4, wherein the illuminated portion of the outer casing is a first color if at least one test of the plurality of tests has the fail condition, wherein the illuminated portion of the outer casing is a second color if at least one test of the plurality of tests is in the threshold approaching the fail criteria, and wherein the first color is different from the second color.

6. The electrical safety analyzer of claim 1, wherein the at least one LED illuminates the transparent portion of the outer casing after each test of the one of the one or more tests, wherein the illumination is green if the test has passed and the illumination is red if the test has failed.

7. The electrical safety analyzer of claim 1, wherein the processor is further configured to:

maintain illumination of the at least one LED after the last test of the plurality of tests has completed if at least one test of the plurality of tests has the fail condition; and turn off the at least one LED based on receiving confirmation of one or more corrective measures for the device to be tested.

8. The electrical safety analyzer of claim 1, wherein the processor is further configured to connect to an external device to display a single color on the external device display indicating the result of the one or more tests.

9. The electrical safety analyzer of claim 8, wherein the external device is at least one of: a smartphone and a tablet, and wherein a screen of the external device displays a green color for a test pass and a red color for a test failure.

10. The electrical safety analyzer of claim 1, further comprising:

a speaker, wherein the processor is further configured to emit one or more tones based on at least one of: a measurement in the one or more tests, a test failure, and a test pass.

11. A method comprising:

running, by a device comprising a processor and addressable memory, a plurality of tests for electrical safety based on a profile of a device to be tested, wherein the profile of the device to be tested comprises a pass criteria and a fail criteria for each test of the plurality of tests;

determining, by the processor, a pass condition or a fail condition for each test of the plurality of tests based on the pass criteria and the fail criteria for each test;

determine if at least one test of the plurality of tests has the fail condition; and illuminating, by the processor, at least one LED after the last test of the plurality of tests has completed if at least one test of the plurality of tests has the fail condition, wherein an illumination of the at least one LED illuminates a transparent portion of an outer casing of the device, and wherein the processor is in communication with the at least one LED.

12. The method of claim 11 wherein the LED illuminates the transparent portion of the outer casing in: a first color if at least one of the one or more tests has failed, a second color if none one of the one or more tests has failed, and a third color if at least one of the one or more tests approaches a threshold close to failing.

13. The method of claim 11 further comprising:

determining, by the processor, if each test of the plurality of tests with the pass condition is in a threshold approaching the fail criteria, wherein the profile of the device to be tested further comprises the threshold approaching the fail criteria illuminating, by the processor, the at least one LED after the last test of the plurality of tests has completed if at least one test of the plurality of tests is in the threshold approaching the fail criteria, wherein the illumination of the at least one LED illuminates the transparent portion of the outer casing.

14. The method of claim 11 further comprising:

transmitting, by the processor in communication with a transceiver, the pass or fail condition of each test.

15. The method of claim 14 further comprising:

receiving, by a user device comprising a processor with addressable memory in communication with a transceiver, the pass or fail condition of each test; and displaying, by a processor of the user device in communication with a display, the received pass or fail condition of each test as a single color on the display of the user device.

* * * * *